US005105984A

United States Patent [19]

Kazimir

[11] Patent Number: 5,105,984

[45] Date of Patent: Apr. 21, 1992

[54] PASTE TUBE DISPENSER AND METHOD FOR MAKING SAME

[76] Inventor: Charles E. Kazimir, 311 Feronia Way, Rutherford, N.J. 07070

[21] Appl. No.: 544,751

[22] Filed: Jun. 27, 1990

[51] Int. Cl.[5] ..... B65D 35/28

[52] U.S. Cl. ..... 222/103; 222/105

[58] Field of Search ..... 222/103, 105, 181, 386.5

[56] References Cited

U.S. PATENT DOCUMENTS

| | | | |
|---|---|---|---|
| 2,515,440 | 7/1950 | Cicero | 222/103 |
| 2,535,671 | 12/1950 | Cutler | 222/105 |
| 2,537,008 | 1/1951 | Abbott | 222/96 |
| 2,600,631 | 6/1952 | Freedman | 222/103 |
| 2,643,029 | 6/1953 | Chapman et al. | 222/103 |
| 2,759,636 | 8/1956 | Albert et al. | 222/103 |
| 2,781,951 | 2/1957 | Hanford | 222/103 |
| 3,096,913 | 7/1963 | Corley | 222/181 |
| 3,326,420 | 6/1967 | Turner | 222/103 |
| 3,675,822 | 7/1972 | Casali et al. | 222/103 |
| 4,111,338 | 9/1978 | Cheng et al. | 222/180 |
| 4,337,769 | 7/1982 | Olson | 222/386.5 |
| 4,565,303 | 1/1986 | Gilbertson | 222/103 |
| 4,722,457 | 2/1988 | Bedwell et al. | 222/103 |

*Primary Examiner*—Kevin P. Shaver
*Assistant Examiner*—Gregory L. Huson
*Attorney, Agent, or Firm*—W. Patrick Quast

[57] ABSTRACT

A dispenser for extruding from a paste tube a paste portion. The dispenser includes a support portion and a cover portion, which have hinges at one end and which enclose a chamber for the paste tube. By pressing on the cover member, a paste portion is extruded from the tube. The hinges are adjustable to suit the tube, when full or one-half full, or near empty. The support portion and cover portion have respective resilient liners for providing a spring rate and for snugly holding the tube.

6 Claims, 6 Drawing Sheets

PRESS
10
12
14
18
20
22
24
26
28
30
32
34
36
38
40
42
44
46
48
50
52
54
56
58
62
64
78
80

FIG-5
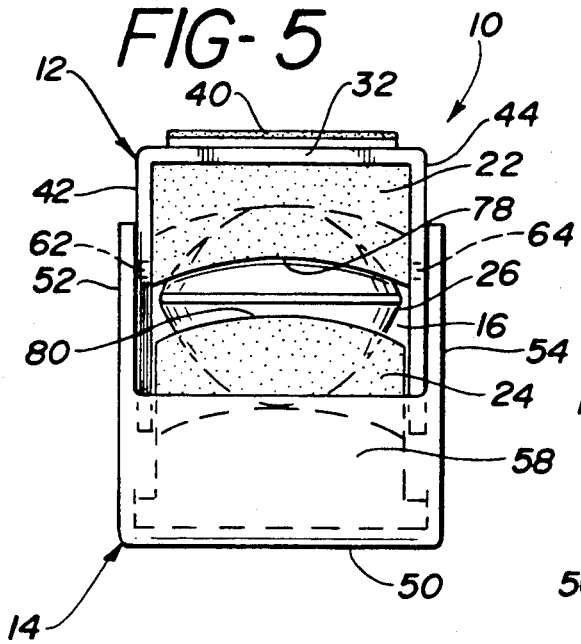
FIG-6
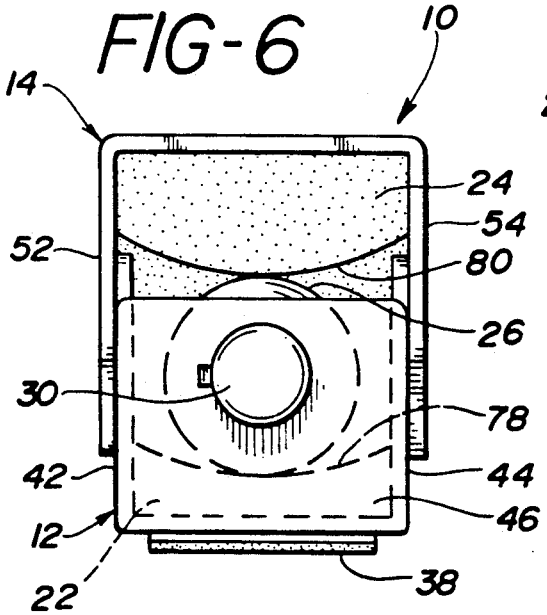
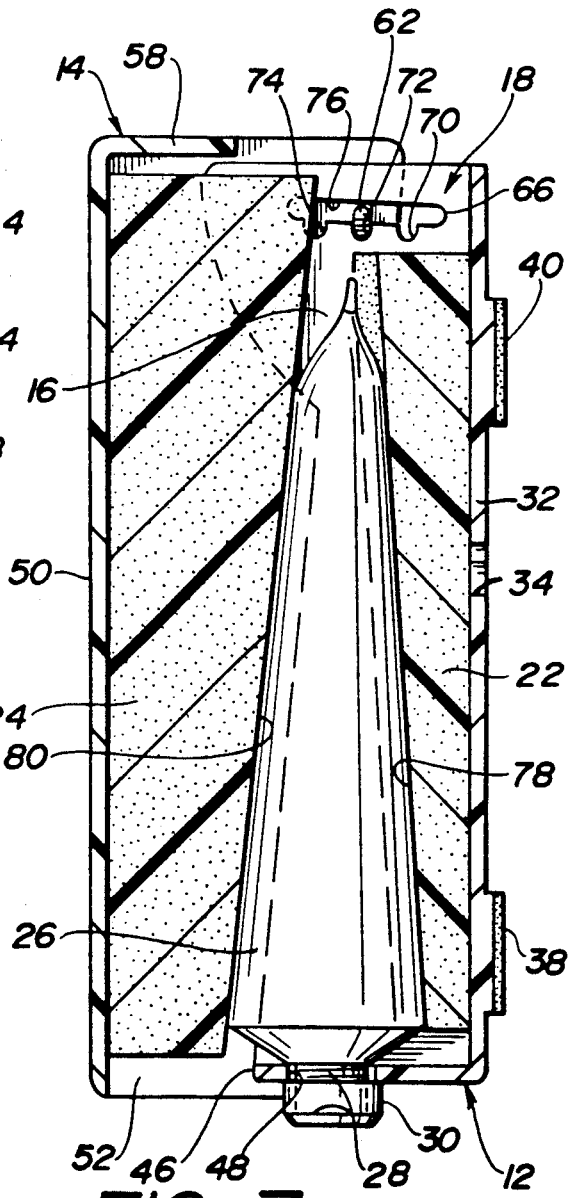
FIG-7

PASTE TUBE DISPENSER AND METHOD FOR MAKING SAME

The invention relates to a paste tube dispenser, and in particular the invention relates to a paste tube dispenser having an elastomeric liner.

BACKGROUND OF THE INVENTION

The prior art paste tube dispenser is described in U.S. Pat. No. 4,565,303 issued Jan. 21, 1986.

Related patents include U.S. Pat. Nos.:

4,111,338, issued Sept. 5, 1978,
2,781,951, issued Feb. 19, 1957,
2,759,636, issued Aug. 21, 1956,
2,643,029, issued June 23, 1953,
2,537,008, issued Jan. 9, 1951,
2,535,671, issued Dec. 26, 1950,
2,515,440, issued July 18, 1950,
DES. 267,993, issued Feb. 22, 1983, and
DES. 204,050, issued Mar. 15, 1966.

The prior art paste tube dispenser includes, a base member having a rear support wall and first and second inner side walls, and includes a cover member hinged to the inner side walls and having a bottom wall and a top wall and first and second outer side walls and a front wall, said front wall and rear support wall and first and second inner side walls forming a variable-volume chamber in which a paste tube is disposed, said bottom wall having an opening which receives a neck of the paste tube for dispensing a portion of paste from the neck upon pressing the front wall towards the rear support wall.

One problem with the prior art paste tube dispenser is that it is difficult to dispense a selective amount of paste from the tube. Further, it is still more difficult to dispense a selective amount of paste from the tube as the tube approaches an empty condition.

SUMMARY OF THE INVENTION

According to the present invention, a paste tube dispenser is provided. This dispenser comprises, a base member having a rear support wall and first and second inner side walls; a cover member having a bottom wall and top wall and first and second outer side walls and a front wall; first and second adjustable hinge means respectively connecting the first inner and outer side walls and the second inner and outer side walls; said front wall and rear wall and first and second inner side walls forming a variable-volume chamber in which a paste tube is disposed, said bottom wall having an opening which receives a neck portion of the paste tube; and first and second resilient liners disposed respectively between the paste tube and the rear wall and between the paste tube and the front wall, for gradually dispensing a portion of paste pressing the front wall towards the rear wall.

By using the first and second resilient liners disposed respectively between the paste tube and the rear wall and between the paste tube and the front wall, a spring rate is applied on the paste tube, as the front wall is pressed towards the rear wall, whereby the portion of paste can be more gradually dispensed. Also, by using the adjustable hinge means, the cover member can be adjustably positioned relative to the rear support wall, thereby reducing the depth of the chamber to suit the paste tube thickness, as the paste tube gradually approaches an empty condition, whereby the volume of the dispensed paste portion can be more accurately controlled.

The foregoing and other objects, features and advantage will be apparent from the following description of a preferred embodiment of the invention as illustrated in the accompanying drawings.

BRIEF DESCRIPTION OF THE DRAWINGS

FIG. 5 is a top view as taken along the line 5—5 of FIG. 3;

FIG. 6 is a bottom view as taken along the line 6—6 of FIG. 3;

FIG. 7 is a section view as taken along the line 7—7 of FIG. 3;

DESCRIPTION OF THE PREFERRED EMBODIMENT

Figure 1:
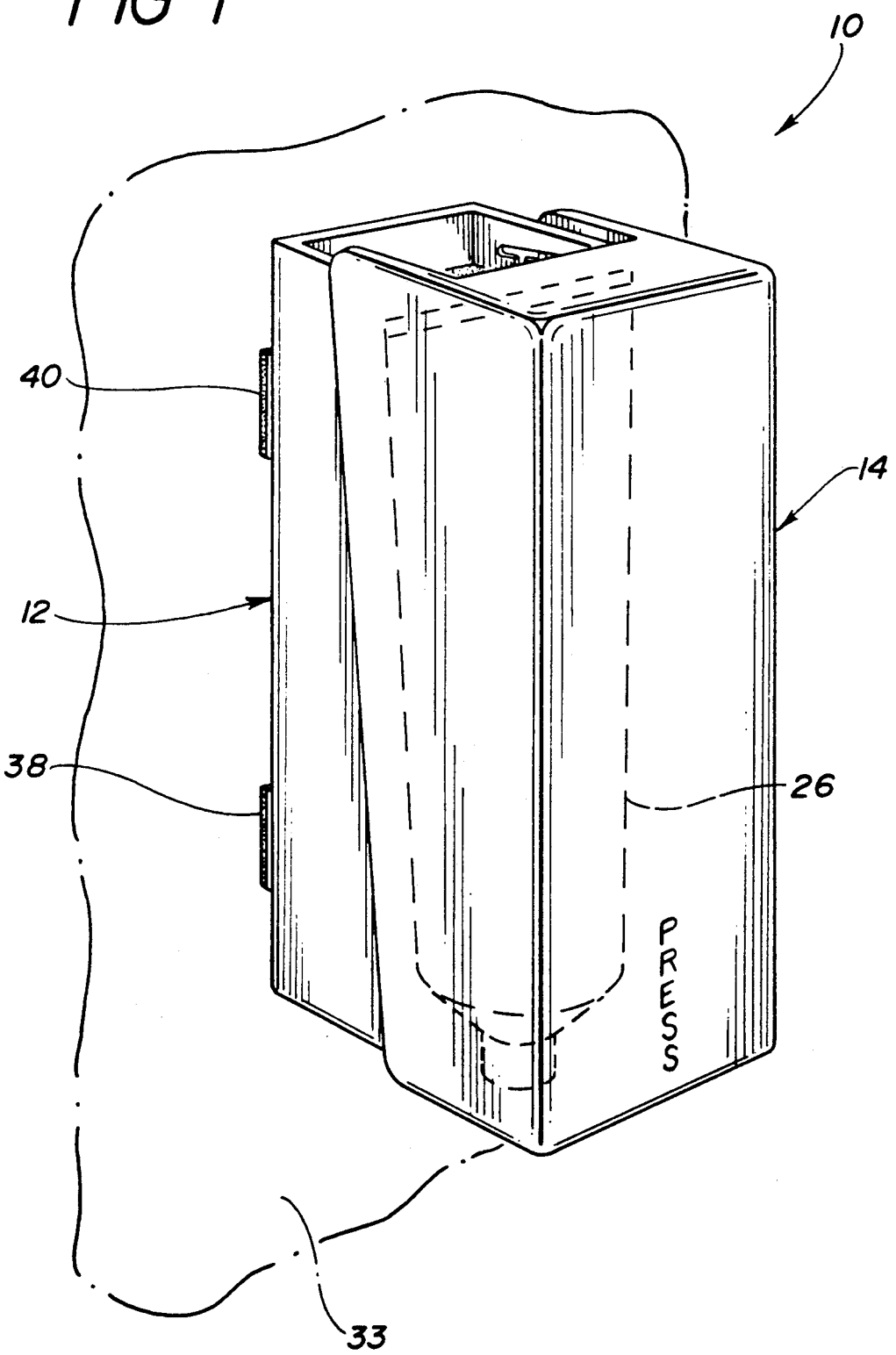
FIG. 1 is a perspective view of a paste tube dispenser according to the invention.
Figure 2:
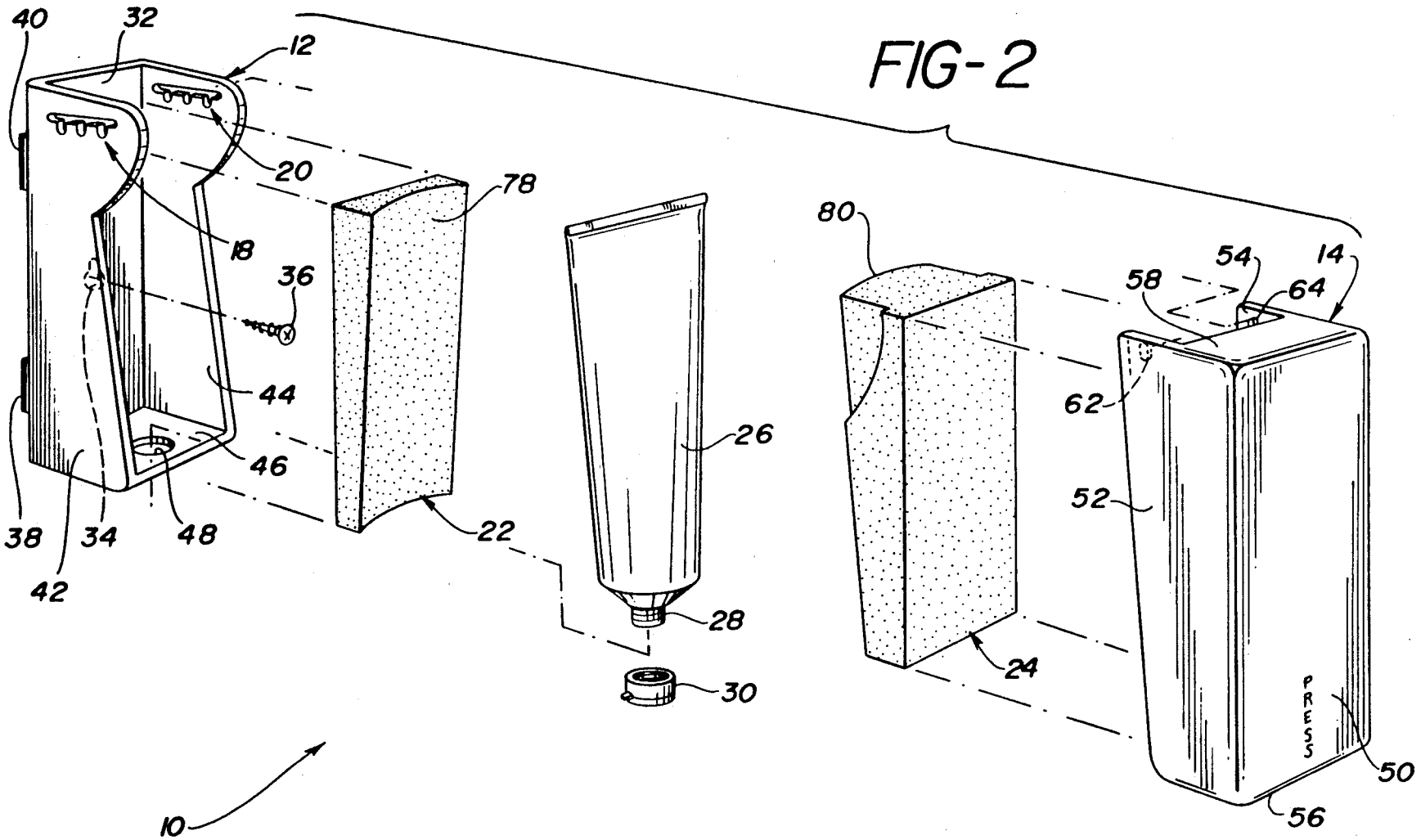
FIG. 2 is an exploded view of the dispenser of FIG. 1.
Figure 3:
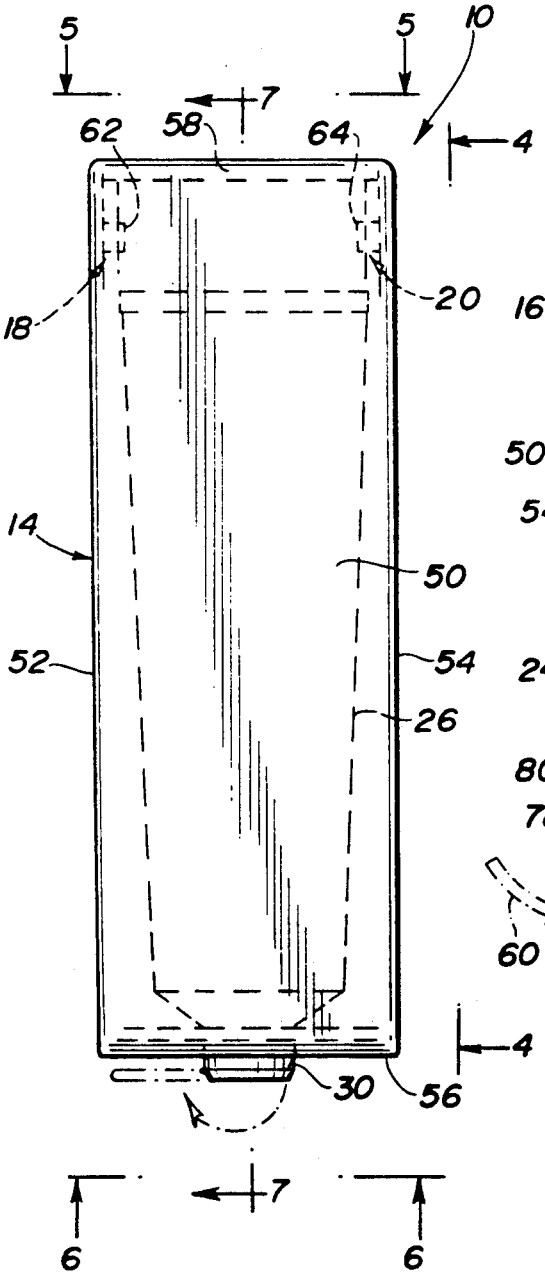
FIG. 3 is a front elevation view of the dispenser of FIG. 1.
Figure 4:
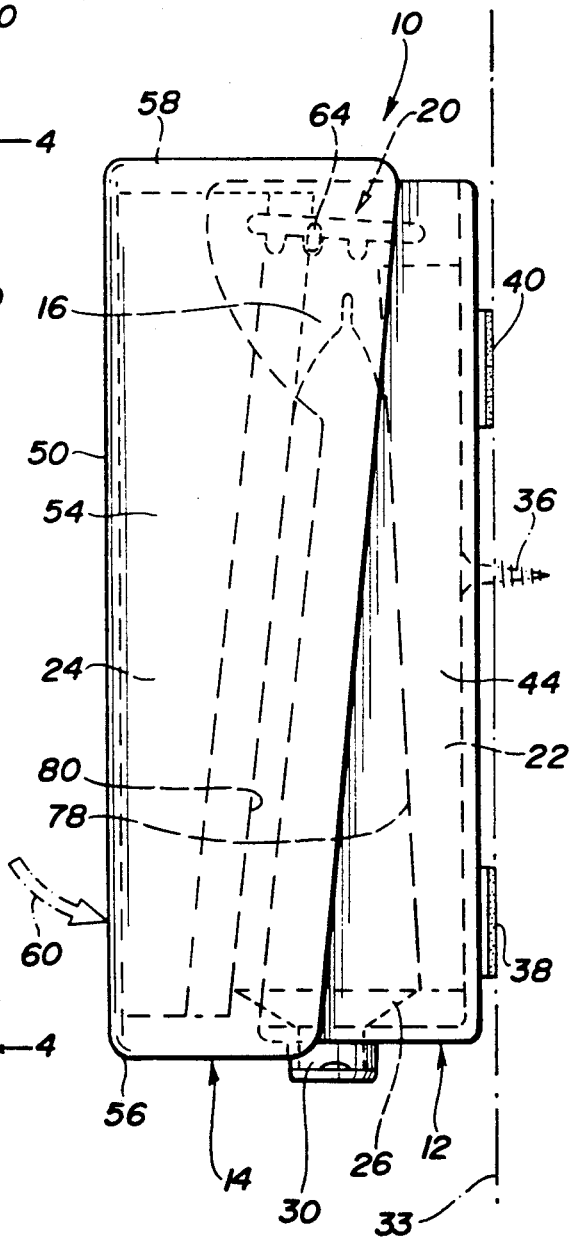
FIG. 4 is a side elevation view as taken along the line 4—4 of FIG. 3.

As shown in FIGS. 1 and 2, a paste tube dispenser 10 is provided. Dispenser 10 includes a support member 12, and a cover member 14, which together with the support member 12 forms a variable-volume chamber or space 16 (FIG. 7) therebetween. Dispenser 10 also includes first and second adjustable hinges 18, 20, and first .and second liners 22, 24. A paste tube 26, which has a neck portion 28 and a cap 30, is placed, when desired, within chamber 16.

Support member 12 has a rear wall 32, which is attached to a building wall or partition 33, or the like. Rear wall 32 has a hole 34, which receives a support screw 36, for mounting to a wood or plaster finish of wall 33. Rear wall 32 also has first and second adhesive strips 38, 40, for mounting to a tile finish of wall 33. Support member 12 also has first and second inner side walls 42, 44, and a bottom wall 46 which has an opening 48 that receives neck 28.

As shown in FIGS. 1, 2, 3 and 4, cover 14 has a front wall 50, first and second outer side walls 52, 54, a bottom edge 56, and a top wall 58. Chamber 16 decreases in volume and in depth by an application of a force 60 which causes a torque on front wall 50.

Figure 8:
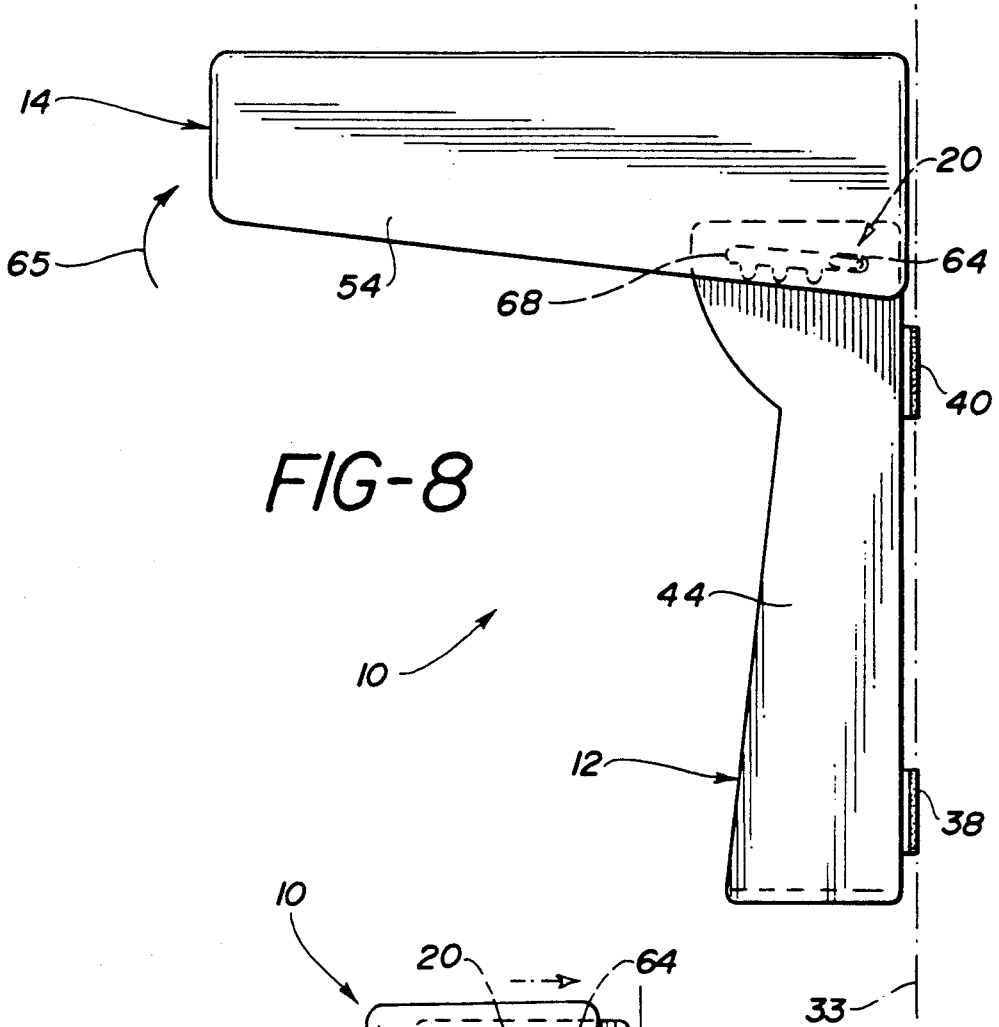
FIG. 8 is a side elevation view corresponding to FIG. 4, except with its cover in an open position.

As shown in FIGS. 3, 4, 7, 8, and 9, hinges 18, 20 have first and second hinge pins or tabs 62, 64, which are fixedly connected to respective inner faces of outer side walls 52, 54. Pins 62, 64 have a profile, in a side view, which is rectangular in shape with rounded ends. Pins 62, 64 hold cover 14 in an open position, if desired. As shown in FIG. 8, a force 65, causes a torque on cover 14, to move cover 14 to a horizontal, open position.

Figure 9:
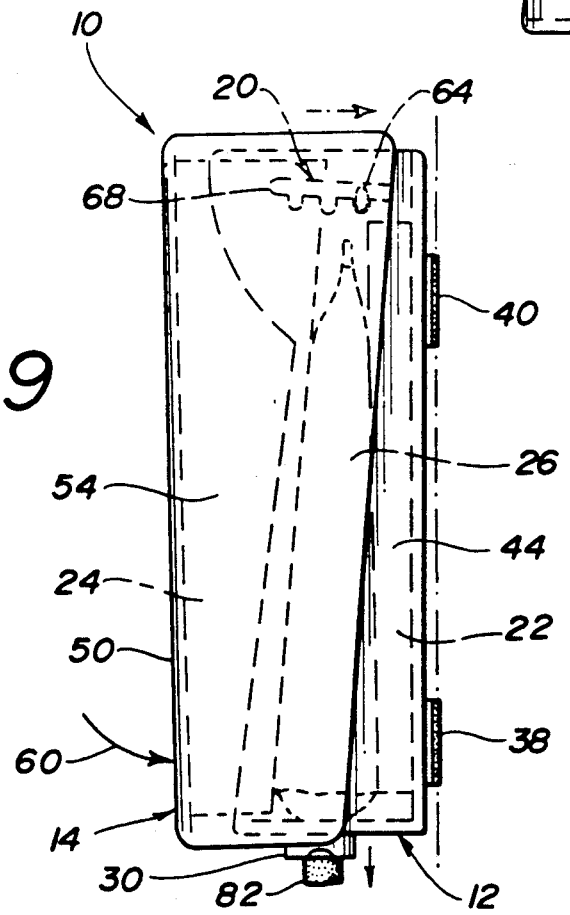
FIG. 9 is a side elevation view corresponding to FIG. 4, except with its hinge means readjusted.

Hinges 18, 20 have respective cutouts 66, 68 in respective walls 42, 44. Cutouts 66,68 are substantially identical, but opposite hand. Cutout 66 (FIG. 7) has a first or near slot 70 a second or middle slot 72, and a third or far slot 74. Slots 70, 72, 74 are vertical slots. Cutout 66 also has a horizontal slot 76. As shown in FIG. 8, cover 14 can be held in an open position by pin 64 and horizontal slot 76. Slot 74 and slot 72 can be used when tube 26 is full or nearly full. Slot 70 can be used when tube 26 is nearly empty, as shown in FIG. 9. Also, tubes of different thicknesses can be used in dispenser 10.

As shown in FIGS. 2, 3, 4 and 9, liners 22, 24 are provided. Liner 22 has a concave inner surface 78. Liner 24 has a convex inner surface 80. Surfaces 78, 80 bear against and apply opposing forces or uniform pressures against opposite surfaces of tube 26. Liners 22, 24 are made of a resilient material such as a sponge material, or elastomeric material, or rubber-like material. Surfaces 78, 80 apply forces, or pressures, with about the same spring rate. Such forces act normal to the surfaces 78, 80 against tube 26, extruding paste portion 82. As tube 26 empties, pins 62, 64 can be moved from slot 74 to slot 72, and then to slot 70, as shown by comparing FIGS. 4 and 9.

Figure 10:
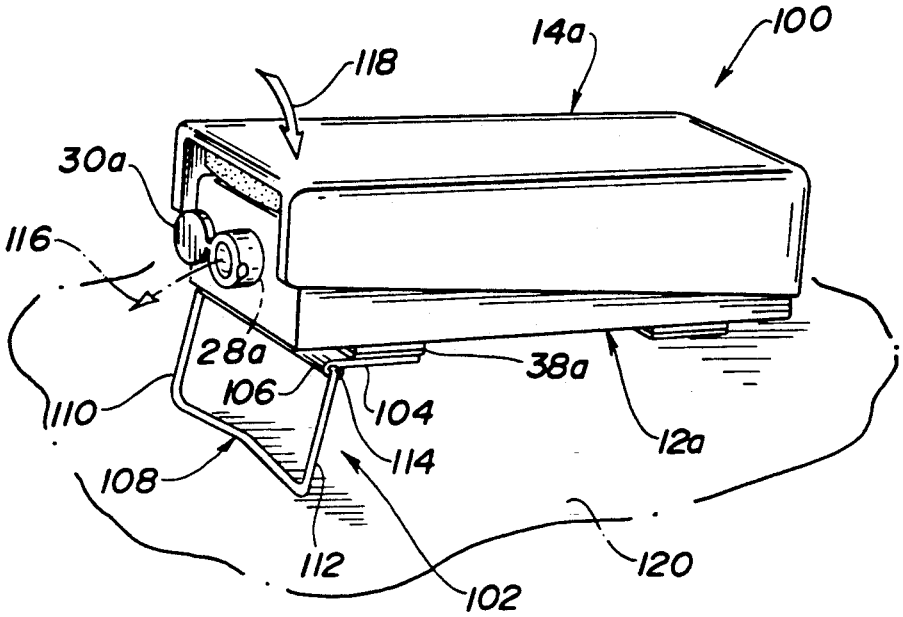
FIG. 10 is a second embodiment of a tube dispenser having a table rest support.

As shown in FIG. 10, a second embodiment or dispenser 100 is provided. Parts of embodiment 100 which are the same as corresponding parts of embodiment 10 have the same numerals, but with a subscript "a" added thereto. Dispenser 100 has a support member **12*a* and a cover member 14*a*, which enclose a tube that has a neck 28*a* with a cap 30*a*. Support 12*a* has a foldable stand 102, which has a solid plate 104, that is attached to adhesive strip 38*a*, and that has corner recesses or return bends 106. Stand 102 also has a bent wire 108, which has vertical leg portions 110, 112, with bent ends 114, that are received in corner recesses 106. In use, dispenser 100 extrudes a paste portion in a direction 116 by the application of a force 118. Stand 102 rests on a table 120**.

Figure 11:
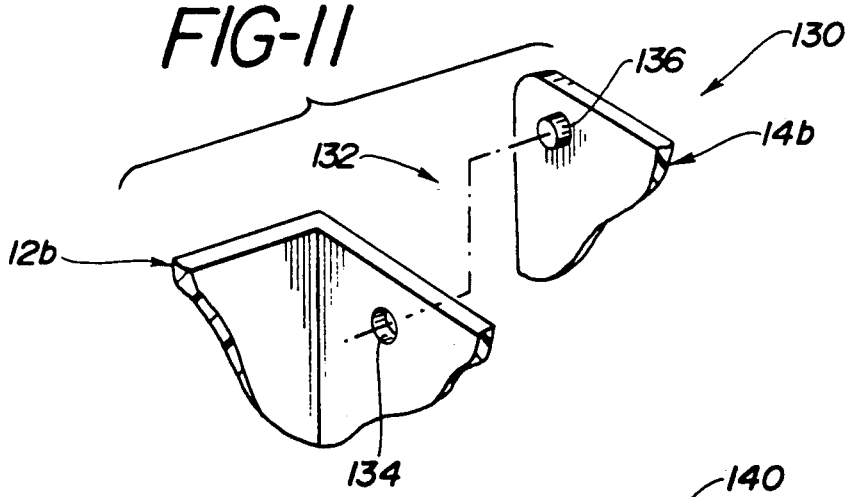
FIG. 11 is a third embodiment of a tube dispenser having a circular hinge pin and hole.

As shown in FIG. 11, a third embodiment or dispenser 130 is provided. Dispenser 130 has a left hinge (not shown) and a right hinge 132, which are identical, but opposite hand. Right hinge 132 has a circular hole 134, which is disposed in a support **12*b*, and has a circular pin 136, which is fixedly connected to a cover 14*b*. This type of hinge 132 is less costly to manufacture than hinge 20 of dispenser 10**.

Figure 12:
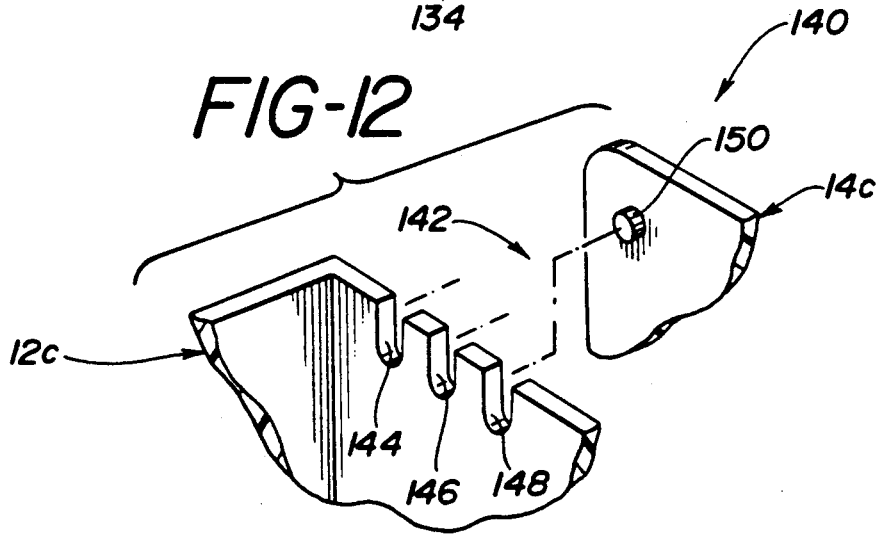
FIG. 12 is a fourth embodiment of a tube dispenser having a circular hinge pin and spaced slots.

As shown in FIG. 12, a fourth embodiment or dispenser 140 is provided. Dispenser 140 has a left hinge (not shown) and a right hinge 142, which are identical, but opposite hand. Right hinge 142 has a near slot 144, a middle slot 146 and a far slot 148 in support **12*c*, and has a circular pin 150 which is fixedly connected to cover 14*c*. This type of hinge 142 is less costly to manufacture than hinge 20 of dispenser 10**.

The advantages of dispenser 10, and dispensers 100, 130, 140, are indicated hereafter.

A) The difficulty of dispensing a selective amount of paste from tube 26 by each of the dispensers 10, 100, 130, 140 is minimized as compared to prior art.

B) The difficulty of dispensing a selective amount of paste from tube 26 by each of the dispensers 10, 100, 130, 140, while the tube 26 is in a nearly empty condition, is minimized.

C) Tubes of different thicknesses can be used in dispenser 10, 100, 130, 140.

D) Dispensers 10, 100, 140 have adjustable hinges such as 18, 20 for adjusting the inside depth between liners 22, 24.

E) Dispensers 10, 100, 130, 140 have liners 22, 24, which are resilient, and which have a selective spring rate, for gradually applying pressure according to the spring rate of the liners.

F) Liners 22, 24 permit a relatively slight pressure on cover 14 before an initial deflection is caused.

G) Liners 22, 24 apply a substantially uniform pressure over both sides of tube 26, when cover 14 is pressed, for deflecting the tube surfaces in a symmetrical fashion.

While the invention has been described in its preferred embodiment, it is to be understood that the words which have been used are words of description rather than limitation and that changes may be made within the preview of the appended claims without departing from the true scope and spirit of the invention in its broader aspects.

The embodiments of an invention in which an exclusive property or right is claimed are defined as follows:

1. A dispenser for a paste tube comprising:

a support member having first and second side walls each including a top portion having at least two slotted portions, and a rear wall, said slotted portions extending approximately perpendicular to the rear wall and located at said top portion;

a cover member having first and second side walls each including a top portion and each having a pin located at said top portion member for positioning in respective ones of the at least two slotted positions;

a variable-volume chamber disposed between said support member and said cover member and having a selective depth dimension;

hinge means comprising said pin members and slotted portions for connecting said support member and said cover member;

said hinge means adjusting said selective depth dimension by positioning thereof between at least a first and second fixed pivotal slotted position, between said support member and said cover member;

liner means disposed in said chamber for transmitting pressure on said tube caused by a force on said cover member;

said liner means including, a first liner disposed adjacent to and contained by the support member and having a first inner surface;

a second liner disposed adjacent to and contained by the cover member and having a second inner surface;

each of the liners composed of a resilient material having a selective spring rate in a direction about normal to its respective inner surface;

said first inner surface in extended arcuate contact with a first coacting surface portion of the tube; and said second inner surface in extended arcuate contact with a second coacting surface portion of the tube.

2. The dispenser of claim 1, wherein said first liner has a shaped first inner surface for bearing against the tube on a one side thereof, said second liner has a shaped second inner surface for bearing against the tube on a second side thereof.

3. The dispenser of claim 1, wherein the liner material is an elastomeric material.

4. The dispenser of claim 1 wherein said hinge means includes;

each said pin fixedly connected to its adjacent cover side wall; and each said at least two slotted portions comprise at least two vertical slots for adjustably positioning the hinge pin in one of said slots.

5. The dispenser of claim 4, wherein said slotted portions include a horizontal slot for receiving the hinge pin; and the hinge pin has a rectangular profile with rounded ends.

6. A method of making a paste tube dispenser including the steps of:

forming a support member and a cover member having a variable-volume chamber disposed therebetween;

hingingly connecting the cover member to the support member at one end thereof;

adjusting the distance from the support member to the cover member between at least a first and second fixed slotted povital position to provide a selected inner depth dimension to suit the thickness of a tube; and adding a first and second resilient liner on inner sides of the support member and cover member respectively with shaped inner surfaces to suit the contour of the tube and for providing desired spring rate when applying a force on the cover member for extruding a paste portion from the tube.

* * * * *